United States Patent [19]

Hauenstein

[11] Patent Number: 4,793,777

[45] Date of Patent: Dec. 27, 1988

[54] CENTRIFUGAL PUMP WITH AUXILIARY IMPELLER OPERATIVELY ASSOCIATED WITH A PRIMARY IMPELLER TO BALANCE THE FORCES ON THE OPPOSITE SIDES THEREOF

[76] Inventor: Ernst Hauenstein, Birkenweg 343, CH-4803 Vordemwald, Switzerland

[21] Appl. No.: 27,493

[22] Filed: Mar. 18, 1987

[30] Foreign Application Priority Data

Mar. 21, 1986 [CH] Switzerland ..... 1160/86

[51] Int. Cl.[4] ..... F04B 17/00; F04D 29/66

[52] U.S. Cl. ..... 417/365; 417/420; 415/106

[58] Field of Search ..... 417/365, 420, 423 R, 417/423 T; 415/98, 104, 106, 140, 131, 11

[56] References Cited

U.S. PATENT DOCUMENTS

| | | | |
|---|---|---|---|
| 2,209,109 | 7/1940 | Bungartz | 415/140 |
| 2,361,521 | 10/1944 | Yates | 415/106 |
| 2,942,555 | 6/1960 | Pezzillo | 417/365 X |
| 3,589,827 | 6/1971 | Gerasimenko | 415/106 |
| 4,648,808 | 3/1987 | Hauenstein | 415/106 X |

FOREIGN PATENT DOCUMENTS

84/04945 12/1984 PCT Int'l Appl. .

*Primary Examiner*—Carlton R. Croyle
*Assistant Examiner*—Leonard P. Walnoha
*Attorney, Agent, or Firm*—Watson, Cole, Grindle & Watson

[57] ABSTRACT

A centrifugal pump of the magneto coupling type in which an isolation shell separates the pump side from the driver side includes an auxiliary impeller arranged additionally to the pump impeller proper. This allows a decreasing of the pressure in the spaces at the reverse side of the pump impeller and thus a balancing of the thrust forces. This effect can be controlled by control means located in the casing at the outer end of the feeding channels of the auxiliary impeller. This allows the provision of a pump of a simple design in which e.g. the isolation shell can be made with an extremely small wall thickness and in which an open or closed pump impeller can be supported without any thrust generated difficulties.

6 Claims, 2 Drawing Sheets

CENTRIFUGAL PUMP WITH AUXILIARY IMPELLER OPERATIVELY ASSOCIATED WITH A PRIMARY IMPELLER TO BALANCE THE FORCES ON THE OPPOSITE SIDES THEREOF

BACKGROUND OF THE INVENTION

1. Field of the Invention

The present invention relates to a centrifugal pump having an output which is separated completely sealingly from the driver side by an isolation shell, and which further includes an impeller supported in an overhung position of a shaft between two axial limit stops, the impeller being driven by a magneto coupling acting through the wall of the isolation shell and being subjected in operation to axial thrust forces generated by relatively differing pressures acting on the front and rear sides thereof, the pump having means operative to balance these thrust forces.

Such centrifugal pumps are generally known. They have an extremely wide field of application, especially in the field of chemistry where specifically poisoness and/or other agressive fluids are conveyed.

2. Description of the Prior Art

The inherent difficulty of known centrifugal pumps of the so-called isolation shell motor-pumps or magneto coupling pumps design has been the absorption and balancing of the hydraulic forces within such pumps, specifically of the thrust forces acting onto the impeller. The presently known solutions have not been satisfactory due to their necessitating intrinsic designs which in addition gave rise to relatively high losses of energy (losses due to friction, decrease of efficiency). This is a quite regrettable fact because modern materials allow a more compact design of the drive system proper and thus enable the overall dimensions to be kept to a minimum.

SUMMARY OF THE INVENTION

It is a general object of the present invention to provide a structurally simple solution for a balancing of the axial thrust forces acting on the impeller of centrifugal pumps of the design set forth above, which solution allows a further simplification of the design of the pump proper and assists in decreasing the inner forces which have occured earlier to such an extent that specifically the isolation shell may be designed with a still more decreased wall thickness thus increasing the overall efficiency of the pump.

A further object of the invention is to provide a centrifugal pump having an auxiliary impeller allocated to its main impeller having relief channels at its front side, i.e., the side facing the medium draw-in pump section, which auxiliary impeller is operative to reduce the pressure prevailing in the chamber or chambers, respectively, located at the reverse side of the impeller.

The chambers located at the reverse side of the impeller side consist commonly of a so-called hub chamber and an inner and outer driver chamber. The two latter chambers are seperated from each other by the carrier of one of the magneto coupling members, which carrier projects flange-like from the reverse side of the impeller. A slot is located between the isolation shell and the rotating parts of the impeller via which a communication of mentioned chambers is established.

In order to obtain a maximal balancing of the thrust forces, control means are provided preferably at the pump casing, and specifically opposite of the periphery of the relief channels of the auxiliary impeller, which control means are preferably control slots or control channels, respectively, and operate to feed the medium fed by the auxiliary impeller from the chamber or space at the rear of the impeller dependent from the relative pressures prevailing at the respective front and reverse, side of the impeller into the pressure chamber of the pump.

The auxiliary impeller is located or formed, at the rear side of the impeller proper, and for instance directly at the rear wall of the impeller.

The feed channels of the auxiliary impeller are preferably designed such that they communicate with one or more chambers at the impeller reverse side. It is for instance possible to allocate a plurality of relief channels to each of the chambers which are to be relieved of pressure. Depending on the magnitude of the respective developed thrust forces, the exit of the relief channels of the auxiliary impeller are more or less covered by the control means, producing an oscillating axial moving of the impeller, which secures a permanent automatic balancing of the thrust forces.

The inventive design of the so-called thrust balancing allows by choice a use of impellers having an open or closed blading.

The bearing journal or supporting shaft of the impeller can be designed, e.g., integrally at the face side of the isolation shell, or in case of larger designs it may be suitably supported within the intake stub of the pump.

It is feasable to design pumps of any kind of desired structure without intrinsic control channels. Furthermore, it is possible to flush the spaces at the rear side of the impeller with cleansing fluids. To this end it is merely necessary to locate a feed line for cleansing fluids in the rearward hub chamber from which certain feed channels of the auxiliary impeller direct the cleansing fluid into the outer driver chamber. Quite obviously, it is possible to direct the cleansing fluid directly into the outer driver chamber.

The inventive design has specific application in pumps in which the driven part is designed as an outer rotor, because on the one hand modern materials allow a producing of rotors having smaller masses and on the other hand practically no frictional losses occur. In spite thereof, it is possible to dimension the unavoidable slot to be extremely narrow because due to the inventive design the danger of a clogging is vastly reduced.

DETAILED DESCRIPTION OF THE PREFERRED EMBODIMENTS

Figure 1:
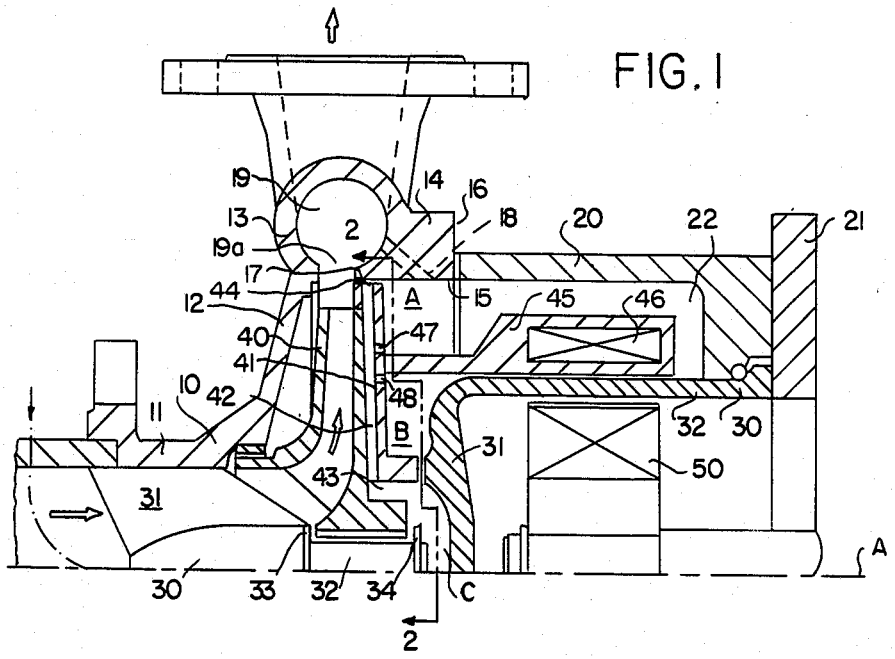
FIG. 1 is a schematic sectional view of the upper half of a centrifugal pump constructed according to a first embodiment of the present invention.
Figure 2:
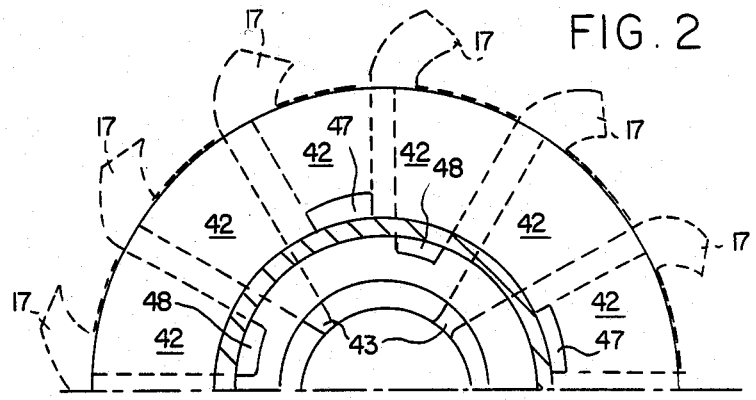
FIG. 2 is a view of the centrifugal pump of FIG. 1 as generally seen along line 2—2 therein.

FIG. 1 schematically depicts the upper half of a first embodiment of a centrifugal pump according to the present invention. The centrifugal pump includes a housing composed of a pump casing 10 and a motor casing 20. The pump casing 10 includes a first annular portion 11 that defines a generally cylindrical intake duct and an axis A through the pump casing, a second annular portion 12 which extends outwardly from the first annular portion, a third annular portion 13 which is located at the outer end of the second annular portion, and a fourth annular portion 14 which extends from the third annular portion in parallel with the first annular portion and which provides an annular inner surface 15 and an annular end surface 16 remote from the third annular portion. The third and fourth annular portions form an annular pressure chamber 19 having an annular inlet mouth 19*a*. The fourth annular portion includes a plurality of circumferentially spaced control slots 17 (see also FIG. 2) which communicate with the annular inlet mouth 19*a*, as well as a plurality of circumferentially spaced bores 18 which extend from the annular pressure chamber 19 to outlet openings in the annular inner surface 15 of the fourth annular portion 14. The motor casing 20 has an annular end surface at one end which is in abutment with the annular end surface 16 of the fourth annular portion 14 of the pump casing 10 and an end wall 21 at its opposite end. A generally cap-shaped isolation shell 30 having a head portion 31 and a side portion 32 is mounted in the motor casing such that the side portion 32 is in contact with the end wall 21 and the head portion 31 faces the intake duct of the pump casing 10. The isolation shell seals the pump side of the centrifugal pump from the drive (motor) side. An annular driving chamber 22 is formed within the motor casing 30 and outwardly of the side portion 32 of the isolation shell 30.

A hub enclosure 30 is mounted within the pump casing 10 by support fins 31, and a bearing journal 32 having end stops 33 and 34 is seated in the hub enclosure 30. Rotatably mounted in an overhang position on the bearing journal is a primary impeller 40 of closed blading design and which, when rotated, causes fluid passing into the pump casing via the intake duct to be pressurized and delivered to the annular pressure chamber 19 via the annular inlet mouth 19*a*. The primary impeller is freely axially movable along the bearing journal 32 between the end stops 33 and 34 based on the axial thrust forces acting on the opposite sides thereof.

An auxiliary impeller 41 is also rotatably positioned within the pump casing between the primary impeller 40 and the head portion 31 of the isolation shell 30. The auxiliary impeller 41 is operatively connectable to the primary impeller 40 such that rotation of the auxiliary impeller will cause rotation of the primary impeller, whereas axial movement of the primary impeller 40 along the bearing journal 32 will cause a corresponding movement of the auxiliary impeller 41. A plurality of radial relief channels 42 are provided by the auxiliary impeller between the primary impeller and the auxiliary impeller, these radial relief channels extending from openings 43 communicating with an annular hub chamber C formed between the primary impeller 40 and the head portion 31 of the isolation shell and peripheral mouths 44 located near the annular inner surface 15 of the fourth annular portion 14 and between the annular inlet mouth 19*a* and the outlet openings of the bores 18. The auxiliary impeller also includes an annular flange 45 which extends into the annular driving chamber 22, thereby dividing it into an outer annular chamber A and an inner annular chamber B. An outer magnet rotor 46 is provided in the annular flange 45. The outer magnet rotor is influenced by an inner magnet rotor 50 (of a drive motor, not shown) rotatably mounted within the isolation shell 30.

In operation, rotation of the inner magnet rotor 50 influences the outer magnet rotor 46 and causes it to rotate, thus causing rotation of both the auxiliary impeller 41 and the primary impeller 40, which in turn causes fluid entering the intake duct of the pump casing 10 to be pressurized and delivered to the annular pressure chamber 19. Most of the pressurized fluid in the pressure chamber 19 passes to a pressure line (not shown). However, some of the pressurized fluid will pass through bores 18 to the outer annular chamber A (formed between the auxiliary impeller 41, the annular flange 45 and the fourth annular portion 14 of the pump casing 10), and then to the inner annular chamber B (formed between the auxiliary impeller 41, the annular flange 45 and the head portion 31 of the isolation shell 30), to the annular hub chamber C, and then through the radial relief channel(s) 42 to peripheral mouths 44, and finally back to the annular pressure chamber via the control slots 17 so as to compensate for the normal pressure build up which occurs in chambers A, B and C. This pressure build up would normally move the primary impeller against the end stop 33. In the present centrifugal pump, as the primary and auxiliary impellers move towards the end stop 33, the effective opening between the mouths 44 and the control slots 17 increases, thus allowing for a greater fluid flow therebetween. As such, the pressure build up in chambers A, B and C is relieved, eventually causing the impellers to reverse their direction of movement and move towards end stop 34. This in turn causes the effective opening between the mouths 44 and the control slots 17 to decrease, thus reducing the fluid flow therebetween. A pressure build up in chambers A, B and C is thereby fostered, causing the impellers to again reverse their direction of movement and move towards end stop 33. An oscillating movement of the impellers along the bearing journal 32 results, the impellers never actually abutting the end stops 33 or 34. In other words, a balance of fluid pressure forces on the opposite sides of the primary and auxiliary impellers is created such that the rotating primary impeller will become positioned between the end stops 33 and 34 of the bearing journal 32. The auxiliary impeller 41 can include openings 47 and 48 therein to enable direct fluid flow from the outer annular chamber A and the inner annular chamber B to at least some of the relief channels 16 (see FIG. 2).

Figure 3:
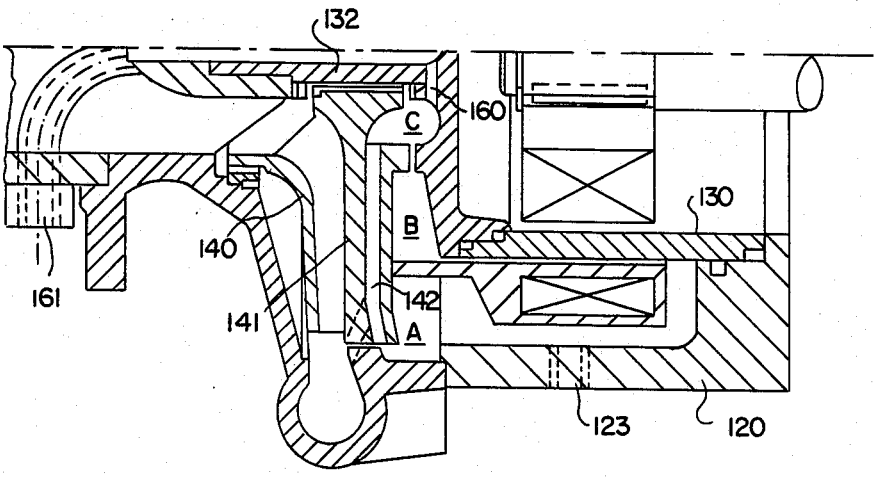
FIG. 3 is a schematic sectional view of the lower half of a centrifugal pump having a magneto coupling and constructed according to a second embodiment of the present invention.

The centrifugal pump illustrated in FIG. 3 is in many ways similar to the pump shown in FIG. 1; however, the auxiliary impeller 141 is integral with the primary impeller 140 and the relief channels 142 formed therebetween do not include openings communicating with the outer or inner annular chambers A, B. In addition, the bearing journal 132 is integral with the isolation shell 130. A bore 160 is provided in the bearing journal to enable a flushing fluid to be supplied to the annular hub chamber C via a conduit 161 connected to the bearing journal. In this way, an efficient flushing or cleaning of the pump can be achieved. An inlet 123 can alternatively be provided in the motor casing 120 to enable a flushing or cleaning fluid to be supplied to the outer annular chamber A.

Figure 4:
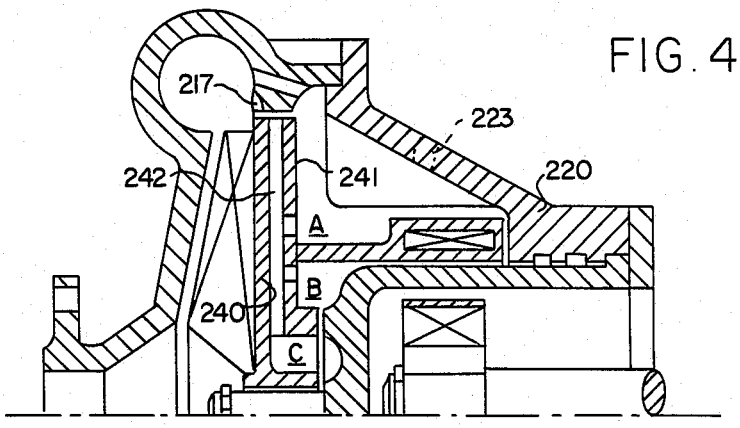
FIGS. 4 and 5 are schematic sectional views of the upper half of a centrifugal pump constructed according to a third embodiment of the present invention, the rotating primary impeller being illustrated at different axial locations on the bearing journal around which it rotates.
Figure 5:
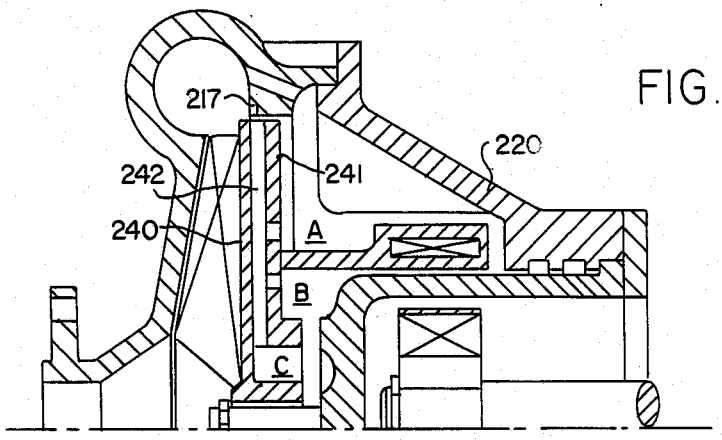

FIGS. 4 and 5 schematically illustrate a third embodiment of centrifugal pump according to the present invention. It is similar to the centrifugal pump of FIG. 1; however, the primary impeller 240 and the auxiliary impeller 241 are unitary and the motor casing 220 and the isolation shell 230 have somewhat modified configurations. The control of the feeding capacity of an auxiliary impeller 241 proceeds via control slots 217 in the motor casing opposite the relief channels 242 of the auxiliary impeller 241. In FIG. 4 the relief channels are closed off such that the pressure will rise in chamber A. FIG. 5 illustrates the situation where the relief channels are located relative to the control slots 217 that a free flow of fluid along the relief channels is enabled, thus resulting in a pressure decrease in chamber A. Note that in FIG. 4 the possibility of including an inlet 223 in the motor casing 220 for flushing or cleaning fluid is indicated.

Although some preferred embodiments of the present invention have now been described in detail, it is obvious that modifications therein could be made and still fall within the scope of the appended claims.

I claim:

1. A centrifugal pump which comprises a pump casing which includes a first annular portion that defines a generally cylindrical intake duct and an axis through said pump casing; a second annular portion which extends outwardly from said first annular portion; a third annular portion which is located at an outer end of said second annular portion; and a fourth annular portion which extends from said third annular portion in parallel with said first annular portion, said fourth annular portion providing an annular inner surface and an annular end surface remote from said third annular portion, said fourth annular portion forming with said third annular portion an annular pressure chamber having an annular inlet mouth, said fourth annular portion also providing a plurality of circumferentially spaced control slots which communicate with said annular inlet mouth and a plurality of circumferentially spaced bores which extend from said annular pressure chamber to outlet openings in said inner surface of said fourth annular portion, a motor casing which defines an annular end surface at one end thereof which is in abutment with said annular end surface of said fourth annular portion of said pump casing and an end wall at its opposite end, said motor casing and said pump casing together forming a housing, a generally cap-shaped isolation shell having a head portion and a side portion mounted in said motor casing, said side portion being in contact with the end wall of said motor casing and said head portion facing said intake duct of said pump casing, an inner magnet rotor rotatably mounted within said isolation shell, a bearing means located along said axis within said pump casing, said bearing means defining two end stops, a primary impeller rotatably mounted on said bearing means and axially movable therealong between said two end stops, said primary impeller, when rotated, causing fluid passing into said pump casing through said intake duct to be pressurized and delivered to said annular pressure chamber via said annular inlet mouth, and an auxiliary impeller rotatably mounted within said pump casing between said primary impeller and the head portion of said isolation shell and operatively connected with said primary impeller such that rotation of said auxiliary impeller will cause rotation of said primary impeller, said auxiliary impeller including an annular flange which extends outwardly of said side portion of said isolation shell and includes an outer magnet rotor, said auxiliary impeller being axially movable with said primary impeller, said auxiliary impeller and said primary impeller providing at least one radial relief channel therebetween which extends from an annular hub chamber between said primary impeller and the head portion of said isolation shell to a peripheral mouth located near said annular inner surface of said fourth annular portion and between said annular inlet mouth and said outlet openings of said bores; the flow of pressurized fluid from said annular pressure chamber through said bores and the flow of fluid from said hub chamber through said at least one radial relief channel to said annular pressure chamber via said control slots when said primary and auxiliary impellers are rotated creating a balancing of forces on opposite sides of the primary impeller such that it will remain positioned between said end stops of said bearing means.

2. A centrifugal pump according to claim 1, wherein said auxiliary impeller, said annular flange and said head portion of said isolation shell define an inner annular chamber therebetween, and said auxiliary impeller, said annular flange, said fourth annular portion of said pump casing and said motor casing define an outer annular chamber therebetween, wherein said auxiliary impeller and said primary impeller define a plurality of radial relief channels therebetween, and wherein said auxiliary impeller includes holes therethrough which connect some of said relief channels with said inner annular chamber and some of said relief channels with said outer annular chamber.

3. A centrifugal pump according to claim 1, wherein said pump casing includes a plurality of supports which extend inwardly from the first annular portion of said pump casing, said supports being connected to said bearing means.

4. A centrifugal pump according to claim 1, wherein said bearing means is integral with the head portion of said isolation shell.

5. A centrifugal pump according to claim 1, wherein said auxiliary impeller is integral with said primary impeller.

6. A centrifugal pump according to claim 1, wherein said bearing means has a flow channel therein in communication with said hub chamber, and including conduit means connected to said flow channel to supply a flushing fluid thereto.

* * * * *